US006524642B1

(12) United States Patent
Leibman et al.

(10) Patent No.: US 6,524,642 B1
(45) Date of Patent: Feb. 25, 2003

(54) ELECTROLESS METAL-PLATING PROCESS

(75) Inventors: Dolly Leibman, New York, NY (US); Jerry G. Du, Southbury, CT (US); Robert C. Andre, Montclair, NJ (US); Nilesh Mistry, Fremont, CA (US); Alan J. Ruffini, Lebanon, NJ (US)

(73) Assignee: OMG Fidelity, Inc., Newark, NJ (US)

( * ) Notice: Subject to any disclaimer, the term of this patent is extended or adjusted under 35 U.S.C. 154(b) by 0 days.

(21) Appl. No.: 09/839,384

(22) Filed: Apr. 21, 2001

(51) Int. Cl.[7] ..... B05D 1/18
(52) U.S. Cl. ..... 427/8; 427/443.1
(58) Field of Search ..... 427/8, 437, 438, 427/443.1

(56) References Cited

U.S. PATENT DOCUMENTS

| | | | | | |
|---|---|---|---|---|---|
| 4,152,164 A | * | 5/1979 | Gulla et al. | ..... | 106/1.27 |
| 4,350,717 A | | 9/1982 | Araki et al. | ..... | 427/8 |
| 4,353,933 A | | 10/1982 | Araki et al. | ..... | 427/8 |
| 4,406,250 A | * | 9/1983 | Araki et al. | ..... | 118/690 |
| 5,182,131 A | | 1/1993 | Hashimoto et al. | ..... | 427/8 |
| 5,200,047 A | | 4/1993 | Hashimoto et al. | ..... | 204/194 |
| 5,755,954 A | | 5/1998 | Ludwig et al. | ..... | 205/794 |
| 5,858,073 A | | 1/1999 | Hine et al. | ..... | 106/122 |
| 6,020,021 A | * | 2/2000 | Mallory, Jr. | ..... | 427/98 |

FOREIGN PATENT DOCUMENTS

| | | | | |
|---|---|---|---|---|
| EP | 0 100 203 A1 | 8/1984 | ..... | C23C/3/02 |

* cited by examiner

*Primary Examiner*—Michael Barr
(74) *Attorney, Agent, or Firm*—Kalow & Springut LLP

(57) ABSTRACT

An improved electroless process for metal-plating a substrate in a plating bath containing metal-plating ions, one or more reducing agents, one or more completing agents, one or more stabilizers and one or more pH adjusters. The improvement comprises adding to the bath an aging composition comprising reaction by-products generated and accumulated in the bath in the course of a plating cycle. The aging composition is present in the bath in a concentration corresponding to the concentration of by-products present in the bath at a desired bath age. The process also involves the continuous or intermittent discharging of a predetermined volume of the bath and the continuous or intermittent replenishment of the bath with one or more replenishing solutions comprising a source of the metal-plating ions, the reducing agents, the complexing agents, the stabilizers and the pH adjusters in a manner so as to maintain the concentration of consumable and non-consumable ingredients in the bath at a steady state.

8 Claims, No Drawings

ELECTROLESS METAL-PLATING PROCESS

FIELD OF THE INVENTION

The invention relates to a process for the electroless metal-plating of a substrate in a plating bath containing an aging composition comprising by-products generated in the course of a plating cycle.

BACKGROUND OF THE INVENTION

Electroless metal-plating of substrates is well known Typically, the substrate is a material such as stainless steel, aluminum, nonconductive surface, etc. The plating metal is typically nickel, boron, cobalt, alloys of nickel or cobalt, copper or alloys of copper.

Fabricators of electroless metal-plated substrates have found that there is a desirable age to be established for electroless metal-plating baths, depending on the particular deposit properties produced by electroless plating. The desirable age of an electroless nickel plating bath is measured in plating cycles, and for the purpose of the discussion which follows, it is assumed that one plating cycle is, in the case of the plating metal being nickel, equal to 6 g/l nickel consumed and replenished. For example, for the plating of aluminum memory disks, the desirable bath age is in the range of about 2 to about 5 plating cycles, for job shop applications, the desirable bath age is in the range of about 2 to about 10 plating cycles.

When a fresh electroless metal-plating bath is initially prepared, such bath has experienced no plating cycles and therefore is undesirable for the electroless metal-plating of a substrate wherein the fabricator desires that the substrate be electrolessly metal-plated in a bath that has experienced at least 0.5 plating cycles. When using a fresh bath, the fabricator's costs are increased because the initial substrates which are electrolessly metal-plated in the fresh bath are unsatisfactory. This results in increased production time, extra costs for the electroless metal-plating bath components as well as for additional costs for waste treatment In the case of electroless metal-plating, the present methods typically involve three different modes of chemical usage:

Bath MakeUp: wherein a metal source, e.g., nickel, a reducing agent, e.g., sodium hypophosphite monohydrate, a chelating agent, e.g., malic acid, a pH adjuster, e.g., sodium hydroxide, and a stabilizer, e.g., lead acetate trihydrate, are combined in water to make-up a plating bath.

Steady State Plating In Respect To Only Consumables: wherein the plated objects are periodically removed from the plating bath and consumables are replenished whenever their concentrations decrease to predetermined threshold levels. In the course of the plating operation, reaction by-products, in addition to the adjunct ions of the consumable ions, accumulate in the bath.

Steady State Plating In Respect To All Ingredients: wherein the plated objects are periodically removed from the plating bath and consumables are replenished whenever their concentration decreases to a predetermined threshold level. In addition, "bleed and feed" operations are concurrently carried out such that a volume of the bath is continuously or intermittently withdrawn from the bath in relation to the level of build-up of by-products beyond a desired maximum concentration in the bath and the ingredients of the Bath Make-up that were withdrawn from the bath are continuously or intermittently added to the bath.

In order to accommodate the three modes of chemical usage, a minimum of three liquid components is required, i.e., bath make-up solution, consumables' replenishment solution and pH adjusting solution, e.g., 28 wt. % ammonium hydroxide. In practice, the foregoing three liquid components are usually further subdivided such that (a) imbalances incurred during plating operations can be offset by small adjustments with such subdivided components and (b) solubility problems inherent in highly concentrated components may be avoided by separating certain ions between components. Accordingly, current commercial practice involves the following:

Bath Make-Up Solution: (1) nickel sulfate component, and (2) reducing agent, chelating agent, pH adjuster and stabilizer component Consumables Replenishment Solution: (1) nickel sulfate component, and (2) reducing agent and stabilizer component pH Adjusting Solution: e.g., 28 wt. % ammonium hydroxide.

From a commercial point of view, it is desirable to bypass mode 2 and proceed directly from mode 1 to mode 3. If such bypass can be achieved, not only does the bath operate at steady state conditions from start to finish with respect to all principal consumables and by-products, but the resultant Ni-P deposits on the plated substrates also exhibit steady state characteristics in respect to their physical properties. To accomplish this goal, a fourth liquid component is required which would be added during the Bath Make-Up mode and supplied in lieu of that volume of water used in the Bath Make-Up that the fourth liquid component would displace. Such fourth liquid component comprises an aging composition which is described in greater detail below.

Objects of the Invention It has been found that for many applications, the most satisfactory electrolessly metal-plated substrates are those which have been plated in a bath which has been "aged", i.e., prepared in a manner so as to contain byproducts which are present in the bath after the bath has experienced a particular bath age, measured in plating cycles.

It is an object of the present invention to provide an aging composition which, when incorporated in the fresh electroless metal-plating bath, will establish a bath having the desired bath age, for the particular substrate and metal in question, such that when electroless metal-plating operations are conducted, there will be no wasted plated substrates, i.e., plated objects not meeting desired physical and chemical specifications. In such an "aged" bath, all the parts will be plated with the utmost consistency from the start to the completion of the plating operation.

It is a further object of the present invention to provide a process whereby substrates may be continuously electrolessly metal-plated in a bath having the desired bath age without any significant waste.

It has been found that in the case of the electroless nickel metal-plating of aluminum memory disks, the process of the present invention results in disks which: (1) are extremely smooth such that polishing pads suffer less wear in post-plating polishing operations; and (2) have "ski-jumps" at the outer diameters of the disks rather than "roll-offs"; in this regard, it should be noted that a polishing machine can readily polish a "ski-jump" down to a level surface, whereas the polishing down of the entire surface of the surface of the disk to level it off to that of the "roll-off" is practically impossible.

The above objects will become apparent from the detailed description of the invention which follows.

SUMMARY OF THE INVENTION

By way of summary, the invention encompasses a process for the electroless metal-plating of a substrate in an "aged" metal-plating bath using "bleed and feed" features described below. The plating bath will contain metal-plating ions, one or more reducing agents, one or more complexing agents, one or more stabilizers and one or more pH adjusters. Prior to commencement of plating operations, an aging composition is added to the bath. Such aging composition comprises reaction by-products, generated and accumulated in the course of a plating cycle, and will be present in the bath in a concentration corresponding to the concentration of the by-products present in the bath at a desired bath age.

Once plating operations have commenced, the aged bath is subjected to "bleed and feed" operations. Such "bleed and feed" operations are well known in the prior art and involve the continuous or intermittent discharge of a predetermined volume of the bath and the continuous or intermittent replenishment of the bath with one or more replenishing solutions comprising a source of the metal-plating ions, the reducing agents, the complexing agents, the stabilizers and the pH adjusters. The "bleed and feed" operations are conducted in a manner so as to maintain the concentration of consumable and non-consumable ingredients in the bath at a steady state.

DETAILS OF THE INVENTION

A freshly prepared electroless metal-plating bath will typically comprise the following components:

Metal-plain Ions: preferably nickel (in the form of nickel sulfate) in the amount of about 3.0 to about 8.0, preferably 4.0–7.0, g/l.

Reducing Agents: preferably sodium hypophosphite monohydrate in the amount of about 20.0 to about 40.0, preferably 25.0–35.0, g/l.

Complexing Agents: preferably malic acid in the amount of about 15 to about 35.0 g/l, preferably 20.0–30.0, g/l.

Stabilizers: preferably lead acetate trihydrate in the amount of about 0.0004 to about 0.0007, preferably 0.0005–0.0006, g/l.

pH Adjusters: preferably 25 Be ammonia in the amount of about 25.0 to about 35.0, preferably 26.5–28.5, g/l.

Based on the components in the typical bath described above, the aging composition by-products will comprise a source of orthophosphite and sulfate ions. Preferably, the orthophosphite ions will be present in the bath in a concentration of about 30 to about 360 g/l and the sulfate ions will be present in the bath in a concentration of about 10 to about 140 g/l. The aging composition by-products may further comprise a source of sodium ions present in the bath in a concentration of about 10 to about 108 g/l and ammonium ions present in the bath in a concentration of about 5 to about 50 g/l.

In general, the concentration of the aging composition in the bath measured as a percentage of the volume of the bath will correspond to a value of about 10 x, wherein x is the desired bath age measured in plating cycles. In the case of the electroless nickel-plating of aluminum memory disks, x will preferably have a value of about 2 to about 5. As mentioned above, a plating cycle is equivalent to 6 g/l nickel consumption in the bath The following nonlimiting examples shall serve to illustrate the advantages of the present invention.

EXAMPLES 1 and 2

In these examples, aluminum memory disks were employed as the substrates. The disks were placed in a plating rack and initially pre-treated as follows:

6 wt. % sulfuric acid etching solution for 5 minutes at 150° F.

2 wt. % zinc zincating solution for 20 seconds at room temperature

50% vtv nitric acid solution for 30 seconds at room temperature 2 wt. % zinc zincating solution for 45 seconds at room temperature The pre-treated disks were then axially rotated through the plating bath at the rate of 8–10 rpm. The bath volume was 4 liters and the loading was 0.40 ft.$^2$/gallon of bath The disks were immersed in the bath for a duration of 120 minutes at 190° F. with a plating rate of 4.5 $\mu$"/min target The tests were carried out with two different baths having the compositions described below in Table I. After bath make-up, each bath was filtered once through a Whatman GF/F filter, then through a Whatman 0.2 $\mu$m nylon membrane filter. The pH of the fresh bath (0 plating cycles—no aging by-products present) was 4.5; the pH of the artificially aged bath (2 plating cycles) was 4.7. The pH for the artificially aged bath was set higher than that of the fresh bath since by-product buildup slows the plating rate down and raising the bath pH offsets the plating rate slowdown.

TABLE I

| Component | Fresh Bath, 0 Plating Cycles | Aged Bath, 2 Plating Cycles |
|---|---|---|
| Water | 3530 ml | 3300 ml |
| 263.7 g/l $NiSO_4$ solution | 240 ml | 240 ml |
| DL malic acid | 100 g | 100 g |
| $NaH_2PO_2.0.8H_2O$ | 116 g | 116 g |
| 0.22 g/l $Pb(Ac)_2.3H_2O$ | 10 ml | 10 ml |
| $NH_4OH$ solution (29 wt. % $NH_3$) | 90 ml (to pH 4.924) | 96.4 ml (to pH 4.7) |
| Conc. $H_2SO_4$ | 155 drops | — |
| $Na_2SO_4$ | — | 116.16 g |
| NaOH | — | 40.18 g |
| $H_3PO_3$ | — | 200.80 g |

For both runs, the workload to volume ratio was kept small so that the baths would not age very much during the course of each run and also in order that the consumables would drop in concentration by only small amounts.

The plating bath data are summarized in Tables II and III below.

TABLE II

| Bath | Initial Ni Conc., g/l | Initial Sodium Hypophosphite Conc., g/l | Initial pH | Final Ni Conc., g/l | Final Sodium Hypophosphite Conc., g/l | Final pH |
|---|---|---|---|---|---|---|
| 0 P.C. | 6.0 | 30.0 | 4.50 | 5.05 | 24.8 | 4.37 |
| 2 P.C. | 6.0 | 30.0 | 4.70 | 5.02 | 24.6 | 4.60 |

TABLE III

| Bath | Deposit Thickness, μ" | Plating Rate, μ"/min | Roughness RA, Å | Roughness TIR, Å | Outer Diameter Ski Jump, Å |
|---|---|---|---|---|---|
| 0 P.C. | 548 | 4.49 | 620 | 18,490 | −2010 |
| 2 P.C. | 552 | 4.60 | 260 | 11,160 | 370 |

N.B.: "P.C." is an abbreviation for plating cycles. Plating bath data were obtained using routine wet chemistry titration analyses and pH values were obtained using a Fisher "Accumet Research AR20" pH/Conductivity Meter. The plating results (deposit thicknesses and plating rates) were generated using the "Veeco XRFA-4200 X-Ray Measurement System." Roughness data ("RA" means Average Roughness and "TIR" meansTotal Indicator Runout) and Ski-jump data were generated from "KLA Tencor P-10 Surface Profiler" scans.

Plating issues were irrelevant between the two baths since they were both found to exhibit the same consumption trends, both decreasing in metal source and reducing agent content and both experienced pH drops as the overall plating reactions produced the expected level of acid generation The artificially aged bath (2 plating cycles) experienced less pH change due to its greater buffering capacity.

From the plating results set forth in Table III above, it is clearly seen that the disk deposits benefitted from the 2 plating cycles of artificial aging since RA decreased by 58%, TIR decreased by 40% and further that the negative value of roll-off (−2010 Å) associated with the fresh bath (0 plating cycles) changed to a positive ski-jump value (370 Å) associated with the artificially-aged bath (2 plating cycles).

What is claimed is:

1. A process for forming an aged electroless metal-plating bath, said process comprising combining an aging composition with a fresh metal-plating bath to form an aged electroless metal-plating bath, wherein said aging composition comprises a concentrate of by-products of an electroless metal-plating process and said fresh metal-plating bath has experienced no plating cycles.

2. The process according to claim 1, wherein the concentration of by-products in the aging composition is determined based on the concentration of by-products present at a determined plating cycle.

3. The process according to claim 2, wherein said plating cycle is between two and five.

4. The process according to claim 3, wherein said by-products are present in said aging composition in a concentration of ten times the concentration in a metal-plating bath at said plating cycle.

5. The process according to claim 2, wherein said aging composition comprises:

a. $SO_4^{-2}$ in an amount between 10 g/L and 140 g/L;

b. $Na^+$ in an amount between 10 g/L and 108 g/L;

c. $H_2PO_3^-$ in an amount between 30 g/L and 360 g/L; and d. $NH_4^+$ in an amount between 5 g/L and 50 g/L.

6. An electroless metal-plating process comprising:

(a) aging a fresh electroless metal-plating bath by combining an aging composition with the electroless metal-plating bath to form an aged electroless metal-plating bath, wherein said fresh metal-plating bath has experienced no plating cycles;

(b) adding a substrate to said aged bath; and (c) plating said substrate.

7. The process according to claim 6 further comprising a bleed and feed step.

8. A method for preparing an aging composition comprising:

a) selecting a desired age of a metal-plating bath; and b) preparing an aging composition for use to age a fresh metal-plating bath that has experienced no plating cycles, wherein said aging composition is comprised of metal-plating by-products in a concentrate for use in the plating bath at about 10x percent, wherein x is the desired age of the metal-plating bath in plating cycles.

* * * * *